United States Patent [19]

Marshall

[11] Patent Number: 4,633,801

[45] Date of Patent: Jan. 6, 1987

[54] STRESS REDUCTION CONNECTION APPARATUS FOR CYLINDRICAL TETHERS

[75] Inventor: Peter W. Marshall, Houston, Tex.

[73] Assignee: Shell Oil Company, Houston, Tex.

[21] Appl. No.: 732,109

[22] Filed: May 9, 1985

[51] Int. Cl.[4] ..... E21B 7/12

[52] U.S. Cl. ..... 114/266; 405/202; 166/345; 285/140

[58] Field of Search ..... 114/264–267; 405/195, 202; 166/342, 356, 344–346, 367, 368; 440/112; 277/97, 216; 285/138–140, 224

[56] References Cited

U.S. PATENT DOCUMENTS

| | | | |
|---|---|---|---|
| 1,871,883 | 8/1932 | Geyer | 277/97 |
| 2,649,315 | 8/1953 | Ipsen | 277/97 |
| 2,925,225 | 2/1960 | Jordan | 285/140 |
| 3,559,410 | 2/1971 | Blenkarn | 61/46.5 |
| 3,563,042 | 2/1971 | Ryan | 61/46.5 |
| 3,601,187 | 8/1971 | Tidwell | 166/0.5 |
| 3,612,176 | 10/1971 | Bauer | 166/0.5 |
| 4,188,156 | 2/1980 | Fisher et al. | 405/195 |
| 4,305,341 | 12/1981 | Stafford | 114/230 |
| 4,363,567 | 12/1982 | Van der Graaf | 405/195 |
| 4,363,570 | 12/1982 | Van der Pot | 114/264 |
| 4,395,160 | 7/1983 | deJong | 405/195 |
| 4,527,501 | 7/1985 | Poldervaart | 114/230 |

*Primary Examiner*—Trygve M. Blix
*Assistant Examiner*—C. T. Bartz

[57] ABSTRACT

The apparatus of the present invention comprises a compliant structure for use in reducing bending stress at the ends of an elongated cylindrical tether which may, for example, be used to connect a floating platform supported by a body of water to the floor thereof. The apparatus comprises a plurality of tubular support members concentrically arranged about the elongated cylindrical tether at the tether's end connection. Each tubular support member is connected to each adjacent tubular support member in a manner that allows the entire assembly of tubular members to deflect in unison as the cylindrical tether deflects.

11 Claims, 4 Drawing Figures

STRESS REDUCTION CONNECTION APPARATUS FOR CYLINDRICAL TETHERS

BACKGROUND OF THE INVENTION

1. Field of the Invention

This invention relates to a compliant structure for reducing bending stress at the points of connection of an elongated cylindrical tether which may be used to connect a floating platform supported by a body of water to anchors in the floor thereof.

2. Description of the Prior Art

In recent years there has been considerable attention directed to the drilling and production of wells located in water, such as offshore in the Gulf of Mexico. Wells may be drilled in the ocean floor from either fixed platforms in relatively shallow water or from floating structures or vessels in deeper water. Fixed platforms usually consist of a working platform supported above the surface of the body of water by a plurality of piles or columns extending from the platform to the ocean floor. This works fairly well in shallow water, but as the water gets deeper the problems of design and accompanying costs become prohibitive. In deeper water it is common practice to drill from a floating vessel. However, the problem of producing the wells, from a permanent installation attached to the seafloor, remains.

In recent years there has been some attention directed toward many different kinds of floating structures. One kind which is attracting attention is the so-called vertically moored platform. A key feature of the vertically moored platform is that the floating platform is anchored to the sea floor only by elongated cylindrical tethers such as pipe. In a common form the floating platform includes a plurality, at least three, of elongated buoyant cylinders which are mutually supported in an upright position and are held to the ocean floor by elongated cylindrical tethers attached to seafloor anchor means.

However, it is possible to reduce the buoyancy means to a single vertical cylinder, and eliminate separate seafloor anchor bases by driving the tether into the marine bottom.

In order to limit vertical excursions of the buoyant single vertical cylinder, and to avoid stretching or buckling of the wells, excess buoyancy must be designed into the floating structure and the floating structure must be moored vertically and rigidly to the ocean floor. In such a vertically moored floating platform, or "Tension Leg Platform," wave induced excursions cause lateral surge, sway and yaw of the floating structure with resulting angular distortion of the vertical elongated cylindrical tethers. If the buoyancy means consists of a single elongated cylinder, or "sparbuoy", angular pitch and roll excursions add to the angular distortion in the elongated tether, particularly at point(s) of attachment to the pivoting body.

In such a vertically moored platform it is usually desirable to maintain the elongated tethers connecting the platform to the ocean floor under a substantial amount of tension. As these connecting tethers are under tension and are also subjected to an angular rotation caused by the excursion of the floating body, the influence of the tension tends to concentrate the maximum angular rotation of the tethers at their points of connection. The resultant maximum bending stresses are correspondingly concentrated at the ends of the tether(s). The resulting increased bending strains, however, should be maintained within acceptable limits.

It has also been proposed to utilize the elongated cylinder tether as a conduit for well conductors or flowlines and for transportation to or from the surface of the produced fluids. These functions make it desirable to fabricate a full open internal bore through the tether.

As disclosed in U.S. Pat. No. 3,559,410 issued Feb. 2, 1971, to Blenkarn et al., various apparatus are disclosed which attempt to reduce these stresses resulting from the bending in these hollow tubular connecting tethers. As shown in FIG. 4 of patent '410 a post is placed inside an elongated cylindrical tether adjacent its lower end to distribute a portion of the stresses from the elongated cylindrical tether to the post. This design, however, places a restriction in the elongated cylindrical tether to any fluid flowing or passing through well tubulars or flowlines located within or forming a portion of the elongated cylindrical tether, and maintenance or inspection costs associated with the operation of this device would be prohibitive since it is located in a relatively inaccessible location.

As described in U.S. Pat. No. 3,563,042 issued Feb. 16, 1971, to C. J. Ryan, a smooth trumpet-shaped cone may be used to limit the bending in cable-type tethers. However, such a device is vulnerable to marine fouling, corrosion, and wear, and is less adaptable to larger diameter cylindrical tethers which would require very exacting tolerances to avoid a contact stress problem.

A stress reduction connection device needs to be disclosed that is simple in design and is easy to install and maintain, and does not act as a flow restriction to fluids that may flow through an elongated cylindrical tether.

SUMMARY OF THE INVENTION

The present invention comprises a stress reduction connection apparatus that surrounds the elongated cylindrical tether with a series of interconnected tubular members. The innermost tubular support member normally operatively contacts in a lateral direction the elongated cylindrical tether and is deflected from a relatively vertical orientation when the end of the elongated cylindrical tether deflects or rotates. An outer tubular support member connected to the innermost tubular member correspondingly deflects in the direction of movement of the elongated cylindrical tether. By proper location of the points of contact between the elongated cylindrical tether and the innermost tubulars, and judicious selection of the stiffness of the outer and inner tubular support members, the curvature in the elongated cylindrical tether may be distributed more evenly over a substantial length of the cylindrical column and bending strains may therefore be maintained within acceptable limits.

Combined behavior of the elongated cylindrical tether, the tubular support members, and the floating structure, may be analyzed with a large deflection finite-element computer program. Behavior of the tether at the marine bottom may be similarly analyzed.

It is an object of the invention to provide an apparatus that is capable of reducing the concentrations of bending stress at the points of connection of the elongated cylindrical tethers to a floating platform and to the marine bottom of a body of water in which the floating platform is partially submerged.

The apparatus of the present invention features a plurality of interconnected tubular members that are concentrically arranged in substantially spaced relationship about the periphery of an elongated cylindrical tether.

Since this interconnected array of tubular members may be easily fabricated, installed, and maintained, the utilization of the apparatus of the present invention may be easily justified.

These and other objects, features, and advantages of the present invention will become apparent from the following detailed description, wherein reference is made to the Figures in the accompanying drawings.

DESCRIPTION OF THE PREFERRED EMBODIMENT

Figure 1:
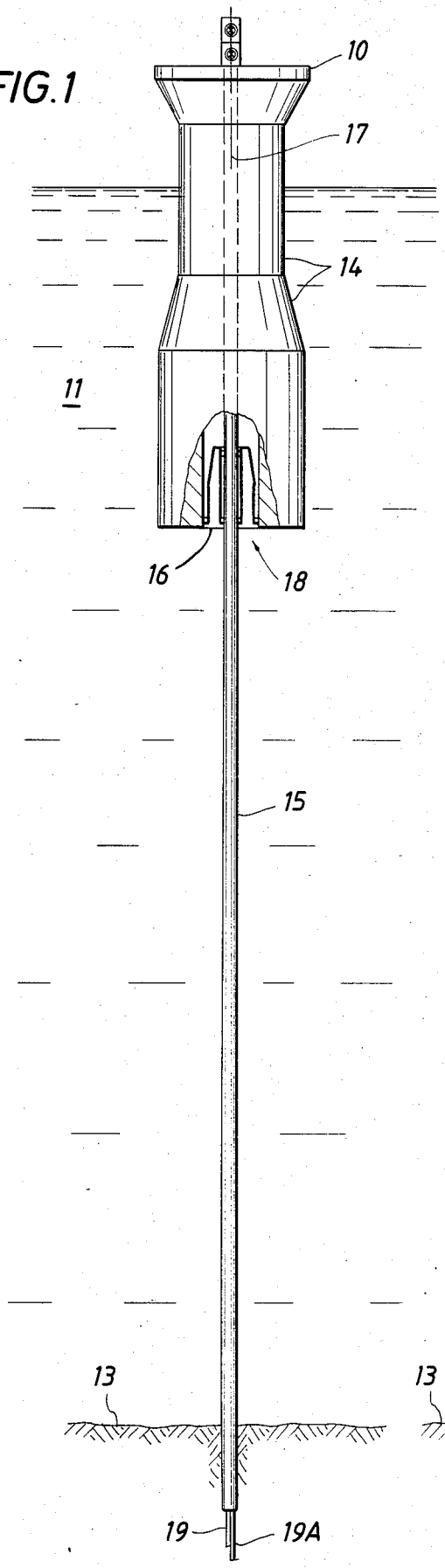
FIG. 1 is a schematic representation showing an elongated cylindrical tether operatively connected between a floating platform and the marine bottom of a body of water.

A floating platform 10 is shown floating in a body of water 11 and is secured to the marine bottom 13 of the body of water 11. Buoyancy is provided to the floating platform 10 by means of a buoyant hull 14 incorporated within the structure of the platform 10.

An elongated cylindrical tether 15 is shown descending vertically downward from the buoyant hull 14 and into the marine bottom 13. The elongated cylindrical tether 15 in this case is used to operatively connect the floating platform 10 to the marine bottom 13. The elongated cylindrical tether 15 can be seen passing upwardly through a central opening 16 which is defined upwardly through the lower portion of the buoyant hull 14 and is secured in a vertical orientation to the upper portion of the buoyant hull. The cylindrical tether 15 typically has a central longitudinal axis 17, and is driven a sufficient distance into the marine bottom 13 to securely anchor the floating platform 10.

A stress reduction connection apparatus 18, the object of the present invention, is shown positioned within the elongated cylindrical tether 15 central opening 16. Location of the stress reduction connection apparatus 18 at the upper end of the elongated cylindrical tether 15 positions the apparatus 18 in the area of the highest bending moment that would be incurred by the upper end of the elongated cylindrical tether 15. It is well recognized that this type of stress reducing connection apparatus 18 may be used in other mechanical applications besides the offshore environment in order to maintain the bending stresses within acceptable limits at the end connections of an elongated cylindrical shaft or tether 15. It is also well recognized that whereas the tether 15 is shown carrying well conductors 19, 19A, the tether 15 may consist solely of a hollow or solid cylindrical column of sufficient strength to anchor the floating platform 10 to the marine bottom 13.

Figure 2:
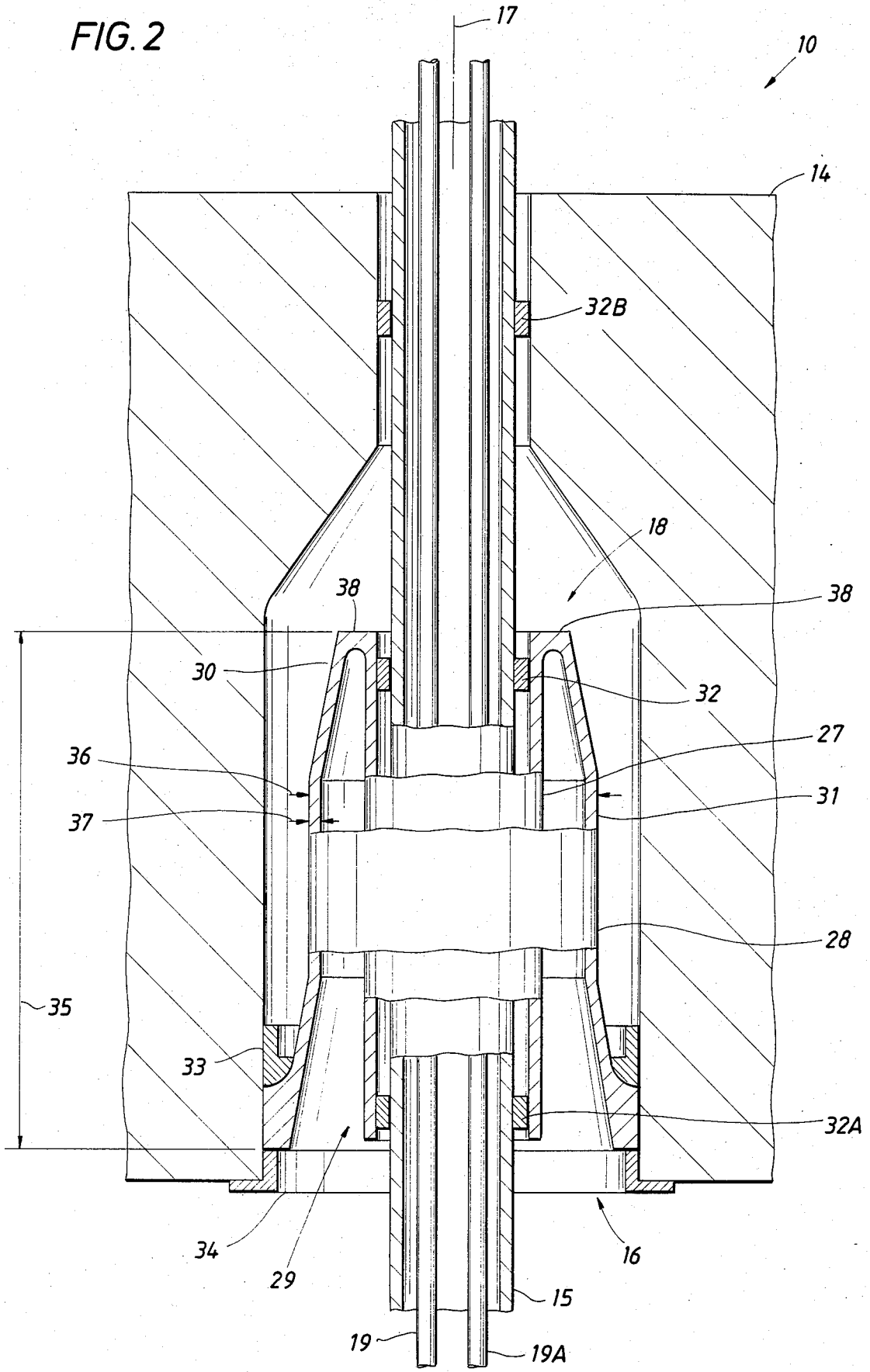
FIG. 2 is a schematic representation showing a stress reduction connection apparatus installed about an undeflected elongated cylindrical tether.

Referring now to FIG. 2, the tether 15 is shown passing upwardly through the central opening 16 defined through the buoyant hull 14. Well conductors 19, 19A are shown carried within tether 15. The stress reduction connection apparatus 18 can be seen to comprise in a preferred embodiment an innermost first tubular support member 27 connected to an exterior second tubular support member 28, members 27, 28 spaced apart from each other at one adjacent end to form an annular space 29. The second tubular support member 28 may have an upper tapered conical section 30 joined to a cylindrical section 31 in a preferred embodiment. Each tubular member 27, 28 such as the second tubular support member 28, will typically have a particular length 35, outer diameter 36, and wall thickness 37 chosen to impart the desired strength and stiffness. Tubular members 27, 28 may be joined at adjacent ends by connection means 38 well known to the art, such as by welding the two members 27, 28 to a common forged ring.

The innermost first tubular support member 27 may, by use of spacer bearing means such as annular rings or spacers 32, 32A, be spaced a selective distance away from the outer surface of the elongated cylindrical tether 15. An additional annular spacer 32B may be used to position the tether 15 within upper parts of the central opening 16. One or more of these spacers 32, 32A, 32B may also function as seals.

Upward movement of the stress reduction connection apparatus 18 through the central opening 16 is prevented in a preferred embodiment by contact of the apparatus 18 with an upper retainer shoulder 33. Downward movement is prevented by use of the lower retainer shoulder 34 located beneath the stress reduction apparatus 18. It is well recognized that many other means of securing the stress reduction connection apparatus 18 within the opening 16 may be used.

Figure 4:
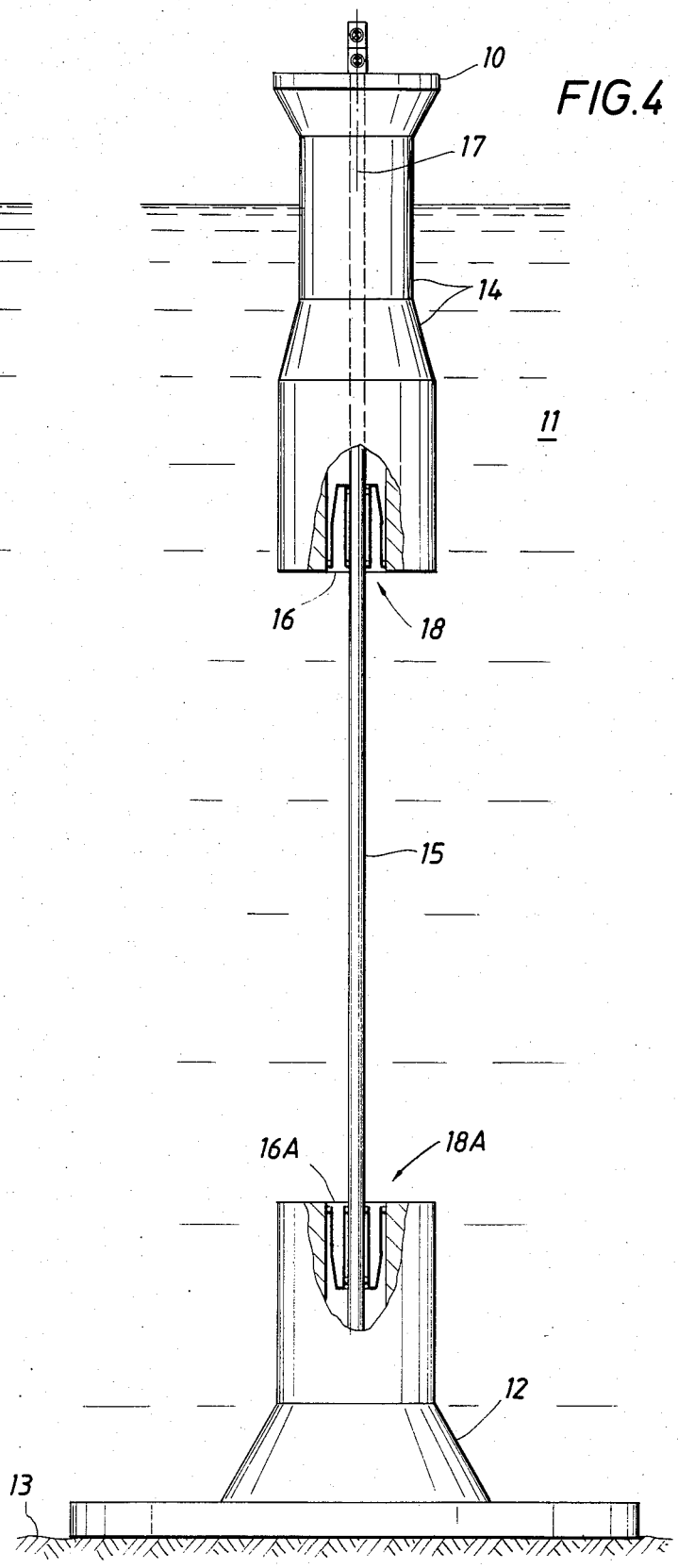
FIG. 4 is a schematic representation showing an alternative application of the stress reduction connection apparatus where the elongated cylindrical tether joins a seafloor anchor means at its lower end.

It should be noted that the elements of the stress reduction connection apparatus 18A (shown in FIG. 4) which may be employed within anchor means 12 located on the marine bottom 13 may be identical to the elements of stress reduction apparatus 18. The elements of the stress reduction apparatus 18A may be orientated, however, in an inverted position relative to the elements of stress reduction apparatus 18. Apparatus 18A may be used at a location where anchor means 12 are required, and where such a device is necessary to reduce the bending stresses at the lower end of tether 15.

Figure 3:
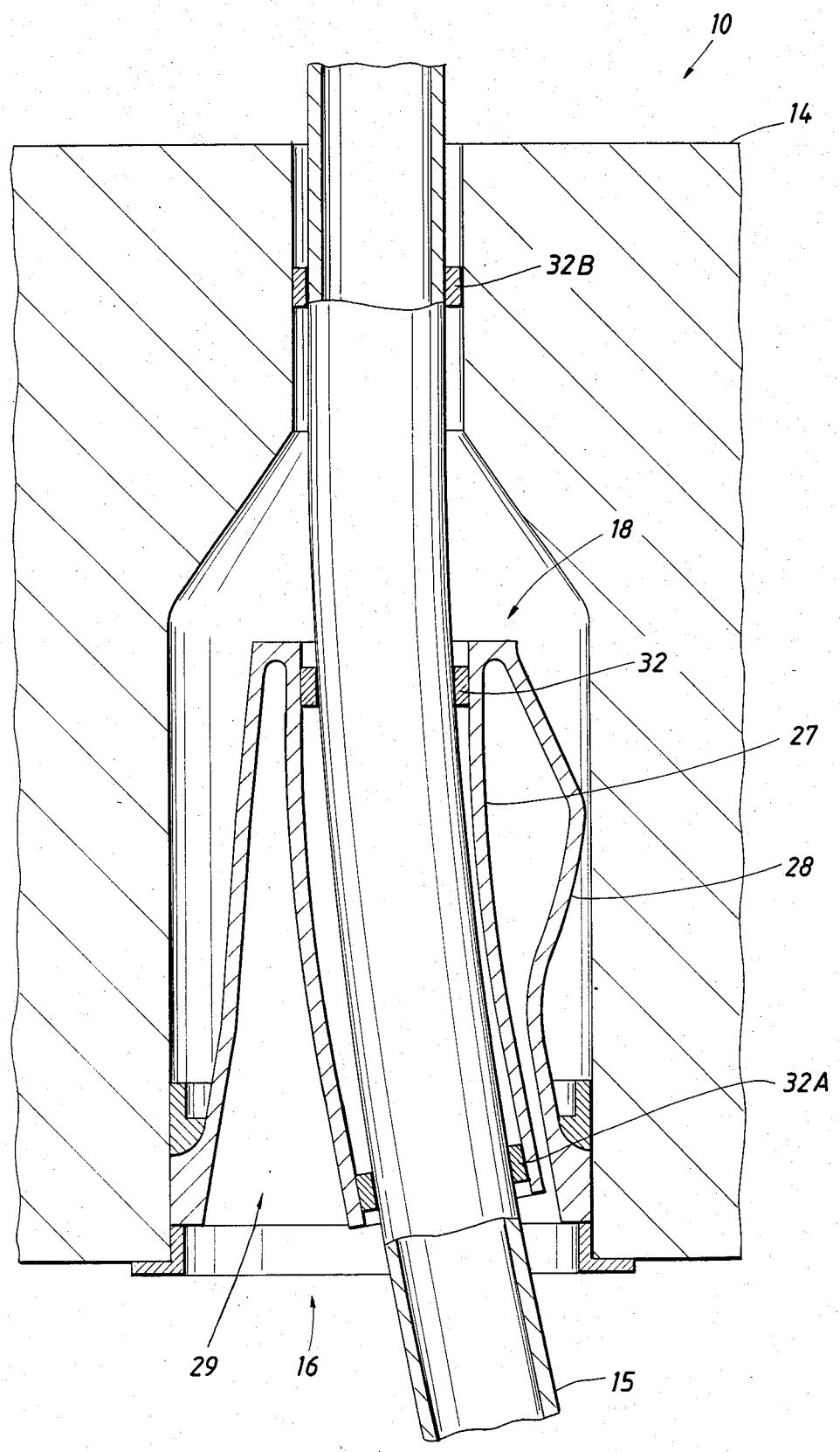
FIG. 3 is a schematic representation showing a stress reduction connection apparatus elastically deformed about a deflected elongated cylindrical tether, as would occur due to excursions of the floating platform.

Referring now to FIG. 3, the stress reduction apparatus 18 is shown in a deflected position due to deflection of the elongated cylindrical tether 15 away from its original central longitudinal axis 17 (FIG. 2) relative to the buoyant hull 14. Note that in a preferred embodiment the exterior second tubular support member 28 has elastically deformed outwardly towards the sides of the central opening 16 whereas the first tubular support member 27 continues to remain positioned relatively parallel to the outer sides of the elongated cylindrical tether 15.

Referring more specifically to the apparatus 18 it can be seen that at least one first tubular support member 27 will have an inner diameter greater than the outer diameter of the elongated cylindrical tether 15, the first tubular support member 27 being placed exterior to and in close-spaced axial relationship about the elongated cylindrical tether 15. As can be seen in FIGS. 2 and 3 the first tubular support member 27 normally operatively contacts points on the outer surface of the elongated cylindrical column 15 by means of spacers 32, 32A. At least one second tubular support member 27 may be located exterior to and in close-spaced axial relationship to at least a portion of the first tubular support member 27 whereupon the second tubular support member 28 will have an inner diameter greater than the outer diameter of the first tubular support member 27.

Referring more specifically to FIG. 2 if the ends of the tubular members 27, 28 are labelled such that the upper ends of the members 27, 28 are labelled the inner ends and the lower ends are labelled the outer ends, the inner end of the second tubular support member 28 is shown operatively connected to the inner end of the first tubular support member 27. The outer end of the second tubular support member 28 is shown operatively secured to the buoyant hull 14 of the floating platform 10. In the case of the apparatus 18A shown inverted relative to apparatus 18 in FIG. 4, the outer end of the second tubular support member 28 is secured to the anchor means 12. It is well recognized that different end orientation configurations may be utilized to accomplish the same mechanical results of apparatus 18, 18A.

Spacer bearing means such as the annular spacers 32, 32A mentioned previously may be carried between the surface defined by the inner diameter of the first tubular support member 27 and the surface defined by the outer diameter of the elongated cylindrical tether 15. More specifically, the spacer bearing means may comprise in a preferred embodiment at least two annular rings or spacers 32, 32A, one of the spacers 32 located adjacent the outer end of the first tubular support member 27, another of the annular spacers 32A located adjacent the inner end of the first tubular support member 27. The annular spacers 32, 32A may be slideably engaged with the outer surface of the elongated cylindrical tether 15 if the annular spacers 32, 32A, in a preferred embodiment, are carried by the first tubular support member 27. Alternatively, the annular spacers 32, 32A may be slideably engaged with the first tubular support member 27, if the spacers 32, 32A are carried by the elongated cylindrical tether 15.

The annular spacers 32, 32A, 32B may be properly separated a selected vertical distance away from each other adjacent the elongated cylindrical tether 15 after calculation of the expected relative movements of the tether 15 under all operating conditions, so that in the deflected position a smooth curve is approximated. Finite element theory may be used to calculate the proper location of the annular rings 32, 32A, 32B and the sizing of the tubular support members 27, 28. Whereas 3 annular rings or spacers 32, 32A, 32B are shown in a preferred embodiment, two annular spacers 32, 32A between the first tubular support member 27 and the tether 15, with an additional annular spacer 32B between the tether 15 and the buoyant hull 14, it is well recognized that other numbers of annular spacers 32 may be incorporated between the first tubular support member 27 and the elongated cylindrical tether 15, as well as between the buoyant hull 14 and the tether 15.

As can be seen in viewing FIGS. 2 and 3, at least a portion of the first tubular support member 27 is shown located within the opening 16 of the buoyant hull 14. It is well recognized, however, that the first tubular support member 27 may also extend substantially outside of the buoyant hull 14, depending upon the geometry required to properly reduce the stresses in the elongated cylindrical tether 15.

Various designs may be utilized to accommodate strength, stiffness, and clearance requirements of the tubular support members 27, 28.

For example, the second tubular support member 28 may include the tapered conical section 30 and the cylindrical section 31 mentioned earlier. As shown in FIGS. 2 and 3, the inner and narrowest end of the tapered conical section 30 may be operatively connected to the inner end of the first tubular support member 27. The outer (lower) end of the tapered conical section 30 may be operatively connected to the inner (upper) end of the cylindrical section 31, with the outer or lower end of the cylindrical section 31 operatively secured to the buoyant hull 14 of the floating platform 10. In this preferred embodiment, the sides of the cylindrical section 31 may be formed substantially parallel to the sides of the first tubular support member 27. It is well recognized that other geometric variations in the form of the first and/or second tubular support members 27, 28 may be made in order to accomplish the desired mechanical response to tether 15 deformation.

As mentioned previously, the second tubular support member 28 may be operatively secured to the buoyant hull 14 by means of upper and lower retainer shoulders 33, 34 which may be positioned above and below a portion of the outer end of the second tubular support member 28. In the preferred embodiment the retainer shoulders 33, 34 have an inner diameter less than the outer diameter of the portion of the second tubular support member 28 which is positioned between the retainer shoulders 33, 34. Positioning the tubular support member 28 outer end in this manner will prevent upward and downward movement not only of the second tubular support member 28 but also the first tubular support member 27 relative to the buoyant hull 14. It is recognized that many other means of fastening the stress reduction support apparatus 18 to the hull 14 may also be used to accomplish the same mechanical result.

Whereas the previous discussion has been limited to consideration of a single exterior second tubular support member 28 mounted outside of the first tubular support member 27, it is well recognized that a series of outwardly extending second support members 28 may be used. The exterior support members 28 extending away from the cylindrical tether 15 may be operatively connected to each other at their ends, the outermost exterior tubular member 28 thereafter may be operatively secured at one of its ends to the buoyant hull 14 of the floating platform 10.

More specifically, a plurality of elongated tubular support members 28 of increasing diameters 36 may be concentrically arranged in substantial spaced relationship to one another. The innermost tubular support member 27, having at least one free end, may be arranged around and normally operatively engage the elongated cylindrical tether 15 which passes axially therethrough. The outermost tubular support member 28 may be concentrically spaced from the innermost tubular support member 27 to form an annular space 29 between the members 27, 28 sufficient to allow the desired amount of displacement, between the disconnected adjacent ends of the members 27, 28.

Connection means 38 which may take any form such as welded members, forged ring, or flanges well known to the art may be used to connect together the adjacent ends of the tubular support members 27, 28 to close the annular space 29 at one end of the members 27, 28 therebetween. The outermost tubular support member 28 may be operatively connected at least at its outer end to the buoyant hull 14. The length 35, diameter 36, and wall thickness 37 of at least one of the tubular members 27, 28 should be sufficient to bend under the lateral and tilting loads applied between the hull 14 and the elongated cylindrical tether 15 without the adjacent ends of the members 27, 28 contacting each other at the open end of the annular space 29.

Each operating environment for the apparatus 18, 18A should be analyzed to determine the proper geometric configuration for best operation of the apparatus 18, 18A under all conditions. For example, the overall length 35 of the apparatus 18 may be 150 feet and the annular space 29 clearance may be 15 feet, in one application with a cylindrical tether diameter of 10 feet, where in another situation these dimensions could conceivably be quite different. Various wall thicknesses 37 may also be used.

In one particular embodiment, the tether 15 may be installed by the well-known method of offshore pile driving, while the floating platform 10 is positioned at the desired location by temporary means (not shown). To prevent static buckling, the tether 15 must be either tensioned or partially deballasted during installation; however, the dynamic impulses of the pile-driving hammer (not shown) will not cause buckling, due to their short duration. After the tether 15 is secured in the marine bottom 13 and attached at its top end to the floating platform 10, the tether 15 is permanently tensioned by deballasting the buoyant hull 14.

Many other variations and modifications may be made in the apparatus and techniques hereinbefore described, both by those having experience in this technology, without departing from the concept of the present invention. Accordingly, it should be clearly understood that the apparatus and methods depicted in the accompanying drawings and referred to in the foregoing description are illustrative only and are not intended as limitations on the scope of the invention.

I claim as my invention:

1. An elongated cylindrical tether stress reduction connection apparatus for use with a floating platform anchored to a marine bottom of a body of water, said floating platform having a buoyant hull and at least one elongated cylindrical tether depending vertically downward from said buoyant hull and secured to said marine bottom, the upper end of each elongated cylindrical tether passing through a central opening defined upwardly through at least a lower portion of said buoyant hull, the upper end of said tether operatively secured to said floating platform, said elongated cylindrical tether stress reduction connection apparatus comprising;

at least a first tubular support member having an inner diameter greater than the outer diameter of said elongated cylindrical tether placed exterior to and in close-spaced axial relationship about said elongated cylindrical tether, said first tubular support member having an inner and an outer end, said first tubular support member normally operatively contacting the outer surface of said elongated cylindrical tether, and at least a second tubular support member of substantially equal length as said first tubular support member located exterior to and in close-spaced axial relationship to at least a portion of said first tubular support member, said second tubular support member having an inner diameter greater than the outer diameter of said first tubular support member, said second tubular support member having an inner and an outer end, said inner end rigidly connected to said inner end of said first tubular support member, said outer end operatively secured to said buoyant hull of said floating platform, said inner end of said second tubular support member capable of movement relative to said outer end of said second tubular support member.

2. The apparatus of claim 1 wherein said elongated cylindrical tether stress reduction connection apparatus further includes spacer bearing means carried between the surface defined by the inner diameter of said first tubular support member and the surface defined by the outer diameter of said elongated cylindrical tether.

3. The apparatus of claim 2 wherein said spacer bearing means further comprises at least two annular spacers, one of said spacers located adjacent the inner end of said inner tubular support member, another of said spacers located adjacent the outer end of said inner tubular support member, said annular spacers slideably engaged with the outer surface of said elongated cylindrical tether, said annular spacers carried by said inner tubular support member.

4. The apparatus of claim 2 wherein said spacer bearing means further comprises at least two annular spacers, one of said spacers located adjacent the end of said first inner tubular support member, another of said spacers located adjacent the outer end of said first tubular support member, said annular spacers slideably engaged with said first tubular support member, said spacers carried by said elongated cylindrical tether.

5. The apparatus of claim 1 wherein at least a portion of said first tubular support member is located within said central opening of said buoyant hull.

6. The apparatus of claim 1 wherein said second tubular support member includes a tapered conical section and a cylindrical section, both sections having inner and outer ends, the inner and narrowest end of said tapered conical section rigidly connected to the first end of said inner tubular support member, the outer end of said tapered conical section rigidly connected to said inner end of said cylindrical section, said outer end of said cylindrical section operatively secured to said buoyant hull of said floating platform.

7. The apparatus of claim 6 wherein the sides of said cylindrical section of said second tubular support member are formed substantially parallel to the sides of said first tubular support member.

8. The apparatus of claim 1 wherein said second tubular support member is operatively secured to said buoyant hull of said floating platform by means of upper and lower retainer shoulders, said upper and lower retainer shoulders respectively positioned above and below a portion of the outer end of said second tubular support member, said retainer shoulders having an inner diameter less than the outer diameter of said portion of said second tubular support member positioned between said upper and lower retainer shoulders to prevent upward and downward movement of said first and second tubular support members relative to said buoyant hull, said retainer shoulders operatively connected to said buoyant hull of said floating platform.

9. An elongated cylindrical tether stress reduction connection apparatus for use in a floating platform anchored to a marine bottom of a body of water, said floating platform having a buoyant hull and at least one elongated cylindrical tether descending vertically downward from said buoyant hull into said marine bottom and secured thereto, the upper end of each elongated cylindrical tether passing through a central opening defined upwardly through at least a lower portion of said buoyant hull, said tether operatively secured to said floating platform, said elongated cylindrical tether stress reduction connection apparatus comprising;

a plurality of elongated tubular support members of increasing diameters concentrically arranged in substantial spaced relationship one to another, and being of substantially equal lengths one to another, the innermost of said tubular support members having at least one end thereof being arranged around and adapted to operatively engage an elongated cylindrical tether passing axially therethrough, the outermost of said tubular support members being concentrically spaced from the innermost tubular support member to form an annular space between said members sufficient to allow displacement between disconnected adjacent ends of the members, means rigidly connecting together the opposite adjacent ends of said tubular members to close the annular space therebetween, said opposite adjacent ends capable of movement relative to said disconnected adjacent ends, the outermost tubular support member being operatively connected at least at its open end to the buoyant hull, said length, diameter and wall thickness of at least one of said tubular members being sufficient to bend under the lateral and tilting forces applied by said elongated cylindrical tether without the advacent ends of said members contacting each other at the open end of said annular space.

10. An elongated cylindrical tether stress reduction connection apparatus for use in anchor means secured to the marine bottom of a body of water, said anchor means having at least one elongated central opening defined downwardly through at least an upper portion of said anchor means and at least one elongated cylindrical tether operatively connected to said anchor means passing upwardly through said opening through said body of water to a floating platform located substantially centrally above said anchor means, said elongated cylindrical tether stress reduction connection apparatus comprising;

a first tubular support member having an inner diameter greater than the outer diameter of said elongated cylindrical tether, placed in close-spaced axial relationship about said elongated cylindrical tether, said first tubular member having an inner and an outer end, said first tubular support member normally operatively contacting the outer surface of said elongated cylindrical tether, and a second tubular support member of substantially equal length as said first tubular support member having an inner diameter greater than the outer diameter of said first tubular support member, placed in close-spaced axial relationship about at least a portion of said first tubular support member, said second tubular member having an inner and an outer end, said inner end rigidly connected to said inner end of said first tubular support member, said outer end operatively secured to said anchor means of said floating platform, said inner end of said second tubular support member capable of movement relative to said outer end of said second tubular support member.

11. An elongated cylindrical tether stress reduction connection apparatus for use with a floating platform anchored to a marine bottom of a body of water, said floating platform having a buoyant hull and at least one elongated cylindrical tether depending vertically downward from said buoyant hull and secured to said marine bottom, the upper end of each elongated cylindrical tether passing through a central opening defined upwardly through at least a lower portion of said buoyant hull, the upper end of said tether operatively secured to said floating platform, said elongated cylindrical tether stress reduction connection apparatus comprising;

at least a first tubular support member having an inner diameter greater than the outer diameter of said elongated cylindrical tether placed exterior to and in close-spaced axial relationship about said elongated cylindrical tether, said first tubular support member having an inner and an outer end, said first tubular support member normally operatively contacting the outer surface of said elongated cylindrical tether, and at least a second tubular support member located exterior to and in close-spaced axial relationship to at least a portion of said first tubular support member, said second tubular support member having an inner diameter greater than the outer diameter of said first tubular support member, said second tubular support member having an inner and an outer end, said inner end operatively connected to said inner end of said first tubular support member, said outer end operatively secured to said buoyant hull of said floating platform, wherein said second tubular support member is operatively secured to said buoyant hull of said floating platform by means of upper and lower retainer shoulders, said upper and lower retainer shoulders respectively positioned above and below a portion of the outer end of said second tubular support member, said retainer shoulders having an inner diameter less than the outer diameter of said portion of said second tubular support member positioned between said upper and lower retainer shoulders to prevent upward and downward movement of said first and second tubular support members relative to said buoyant hull, said retainer shoulders operatively connected to said buoyant hull of said floating platform.

* * * * *